US011158919B2

(12) United States Patent
Uemichi

(10) Patent No.: US 11,158,919 B2
(45) Date of Patent: Oct. 26, 2021

(54) BAND-PASS FILTER COMPRISING A SUBSTRATE ENCLOSED BY CONDUCTIVE LAYER PAIRS AND A POST WALL TO DEFINE A PLURALITY OF RESONATORS HAVING RECESSES OF DIFFERENT DEPTHS

(71) Applicant: FUJIKURA LTD., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 88 days.

(21) Appl. No.: 16/603,645

(22) PCT Filed: Apr. 6, 2018

(86) PCT No.: PCT/JP2018/014755
§ 371 (c)(1),
(2) Date: Oct. 8, 2019

(87) PCT Pub. No.: WO2018/190272
PCT Pub. Date: Oct. 18, 2018

(65) Prior Publication Data

US 2021/0091442 A1 Mar. 25, 2021

(30) Foreign Application Priority Data

Apr. 11, 2017 (JP) ..... JP2017-078057

(51) Int. Cl.
*H01P 1/208* (2006.01)
*H01P 1/207* (2006.01)
(Continued)

(52) U.S. Cl.
CPC ..... *H01P 1/2088* (2013.01); *H01P 1/2002* (2013.01); *H01P 1/207* (2013.01);
(Continued)

(58) Field of Classification Search
CPC ..... H01P 1/2002; H01P 1/2088; H01P 7/065; H01P 3/121
(Continued)

(56) References Cited

U.S. PATENT DOCUMENTS 6,005,456 A * 12/1999 Matsumoto et al. . H01P 1/2056 333/202
6,160,463 A * 12/2000 Arakawa et al. ..... H01P 1/2056 333/202
(Continued)

FOREIGN PATENT DOCUMENTS

CN 2796130 Y 7/2006
CN 104319435 A 1/2015
(Continued)

OTHER PUBLICATIONS

Lee, Boyoung et al., "K-Band Frequency Tunable Substrate-Integrated-Waveguide Resonator Filter With Enhanced Stopband Attenuation", IEEE Transactions on Microwave Theory and Techniques, vol. 63, No. 11, Nov. 1, 2015, pp. 3632-3640.
(Continued)

*Primary Examiner* — Benny T Lee
(74) *Attorney, Agent, or Firm* — Westerman, Hattori, Daniels & Adrian, LLP

(57) ABSTRACT

An object of the present invention is to prevent or reduce an error between a center frequency and a target center frequency in a coupled resonator band-pass filter which uses a post-wall waveguide. A band-pass filter (1) includes: a substrate (2) made of a dielectric substrate and sandwiched by a pair of conductor layers (3 and 4); and a post wall (11, 12) constituted by a plurality of conductor posts (11*i*, 12*i*) which pass through the substrate (2) and short-circuit the pair of conductor layers (3 and 4), the pair of conductor layers (3 and 4) and the post wall (11, 12) constituting a plurality of resonators (22 to 24) which are coupled, the pair
(Continued)

of conductor layers serving as a pair of wide walls of the plurality of resonators, the post wall serving as a narrow wall of the plurality of resonator. The plurality of resonators include at least one resonator (22 to 24) which is provided with at least one recess (221 to 241) which passes through either one (the conductor layer 4) of the pair of wide walls and directly leads to inside the substrate (2).

7 Claims, 7 Drawing Sheets

(51) Int. Cl.

| | |
|---|---|
| ***H01P 7/06*** | (2006.01) |
| ***H01P 11/00*** | (2006.01) |
| ***H01P 1/20*** | (2006.01) |
| ***H01P 3/12*** | (2006.01) |

(52) U.S. Cl.
CPC ..... *H01P 3/121* (2013.01); *H01P 7/06* (2013.01); *H01P 7/065* (2013.01); *H01P 11/002* (2013.01)

(58) Field of Classification Search
USPC ..... 333/212
See application file for complete search history.

(56) References Cited

U.S. PATENT DOCUMENTS

| | | | | |
|---|---|---|---|---|
| 7,009,470 | B2 * | 3/2006 | Yatabe et al. ..... | H01P 1/2088 333/208 |
| 2004/0041663 | A1 * | 3/2004 | Uchimura et al. .... | H01P 1/2088 333/135 |
| 2007/0120628 | A1 | 5/2007 | Jun et al. | |
| 2009/0002104 | A1 | 1/2009 | Chuang et al. | |
| 2009/0243762 | A1 | 10/2009 | Chen et al. | |
| 2016/0372373 | A1 | 12/2016 | Asahi | |

FOREIGN PATENT DOCUMENTS

| | | | |
|---|---|---|---|
| CN | 204130672 | U | 1/2015 |
| CN | 106410360 | A | 2/2017 |
| EP | 0 331 233 | A2 | 9/1989 |
| JP | H08-162805 | A | 6/1996 |
| JP | H10-93311 | A | 4/1998 |
| JP | H11-239006 | A | 8/1999 |
| JP | H11-284409 | A | 10/1999 |
| KR | 10-2010-0097392 | A | 9/2010 |
| WO | 2012/004818 | A1 | 1/2012 |

OTHER PUBLICATIONS

Yusuke Uemichi, et al., "Compact and Low-Loss Bandpass Filter Realized in Silica-Based Post-Wall Waveguide for 60-Ghz applications", IEEE MTT-S IMS, May 2015. (3 pages).

The International Preliminary Report on Patentability (Form PCT/IB/338) issued in counterpart International application No. PCT/JP2018/014755 dated Oct. 24, 2019 with Forms PCT/IB/373 and PCT/ISA/237, with English translation. (14 pages).

International Search Report dated May 15, 2018, issued in counterpart application No. PCT/JP2018/014755, with English translation. (3 pages).

* cited by examiner

BAND-PASS FILTER COMPRISING A SUBSTRATE ENCLOSED BY CONDUCTIVE LAYER PAIRS AND A POST WALL TO DEFINE A PLURALITY OF RESONATORS HAVING RECESSES OF DIFFERENT DEPTHS

TECHNICAL FIELD

The present invention relates to a band-pass filter which limits a radio wave passband.

BACKGROUND ART

FIGS. 1 and 2 of Patent Literature 1 each describe a technique for adjusting a center frequency of a passband in a band-pass filter (BPF) which limits a passband within which a signal propagates through a metallic waveguide tube. The BPF described in each of FIGS. 1 and 2 of Patent Literature 1 is a coupled resonator BPF including three-pole resonators which are coupled.

The waveguide tube of the BPF has a side surface provided with conductor insertion holes which are as many as the resonators. The conductor insertion holes are provided so that conductor bars are to be inserted in the respective conductor insertion holes from outside to inside of the waveguide tube. The BPF can adjust the center frequency by adjusting an amount in which a conductor bar protrudes to inside of the waveguide tube.

The BPF of Patent Literature 1 uses a metallic waveguide tube. As another aspect of the BPF, a BPF which uses a post-wall waveguide (PWW) is known. For example, a BPF described in FIG. 1 of Non-Patent Literature 1 is manufactured with use of a substrate which is sandwiched by a pair of conductor layers and is made of a dielectric substrate (made of silica in Non-Patent Literature 1). In the substrate, a plurality of resonators which are coupled to each other are provided. The plurality of resonators have (i) a pair of wide walls which is the pair of conductor layers and (ii) a narrow wall which is a post wall constituted by a plurality of conductor posts provided in a fence-like manner. Thus, a BPF which uses such a PWW is a coupled resonator BPF.

CITATION LIST

Patent Literature

[Patent Literature 1]
Japanese Patent Application Publication, Tokukaihei, No. 8-162805 A (Publication Date: Jun. 21, 1996)

Non-Patent Literature

[Non-patent Literature 1]
Yusuke Uemichi, et. al, Compact and Low-Loss Bandpass FilterRealized in Silica-Based Post-Wall Waveguide for 60-GHz applications, IEEE MTT-S IMS, May 2015.

SUMMARY OF THE INVENTION

Technical Problem

As compared with the BPF which is described in Patent Literature 1 and uses a waveguide tube, the BPF which is described in Non-Patent Literature 1 and uses a PWW is more compact, is smaller in transmission loss, and is more easily integrated as part of a radio frequency integrated circuit (RFIC). Furthermore, a BPF which uses a PWW can be manufactured by a method for manufacturing a printed circuit board. Thus, the BPF which uses a PWW can further reduce manufacturing cost as compared with a BPF which uses a waveguide tube.

In contrast, as in the case of the BPF which uses a waveguide tube, also in the case of the BPF which uses a PWW, a center frequency thereof may differ from the center frequency (target center frequency) intended in designing the BPF.

The center frequency and the target center frequency differ in the BPF due in part to a manufacturing error in diameter of the conductor posts. A conductor post is completed by forming a through-hole on a substrate first and then forming a conductor film on an inner wall of the through-hole. In a case where the through-hole has a diameter which is smaller than the diameter intended in designing the BPF, the center frequency is shifted to a frequency lower than the target center frequency. In contrast, in a case where the through-hole has a diameter which is larger than the diameter intended in designing the BPF, the center frequency is shifted to a frequency higher than the target center frequency.

In a case where the center frequency of the BPF is shifted from the target center frequency, a part of a passband of the BPF falls outside the range of the band authorized by the Radio Law (hereinafter referred to as the "authorized band"). A BPF which has a passband a part of which is thus outside the range of the authorized band cannot be shipped as a product for sale.

Note here that the technique disclosed in Patent Literature 1 is considered to be applied to a BPF which uses a PWW. However, it is difficult to apply the technique disclosed in Patent Literature 1 to a BPF which uses a PWW. This is because a BPF which uses a PWW (i) is assumed to be operated in a millimeter waveband and (ii) is much more compact than a BPF which uses a waveguide tube. For example, the substrate of the BPF of Non-Patent Literature 1 has a thickness of 500 μm. It is impractical to insert a thin conductor bar in such a thin substrate and to precisely control an amount of protrusion of the conductor bar and fix the conductor bar.

The present invention has been made in view of the above-discussed problems, and an object of the present invention is to prevent or reduce an error between a center frequency and a target center frequency in a coupled resonator BPF which uses a PWW.

Solution to the Problem

In order to attain the object, a band-pass filter in accordance with an aspect of the present invention includes: a substrate made of a dielectric substrate and including a pair of conductor layers provided on respective both sides of the substrate; and a post wall constituted by a plurality of conductor posts which pass through the substrate and short-circuit the pair of conductor layers. The pair of conductor layers and the post wall constitute a plurality of resonators which are electromagnetically coupled, the pair of conductor layers serving as a pair of wide walls of the plurality of resonators, the post wall serving as a narrow wall of the plurality of resonators. According to the present band-pass filter, the plurality of resonators include at least one resonator which is provided with at least one recess which passes through either one of the pair of wide walls and directly leads to inside of the substrate.

Advantageous Effects of the Invention

An aspect of the present invention makes it possible to prevent or reduce a difference between a center frequency and a target center frequency in a coupled resonator BPF which uses a PWW.

DETAILED DESCRIPTION OF THE EMBODIMENTS

Embodiment 1

(Configuration of band-pass filter 1)

Figure 1:
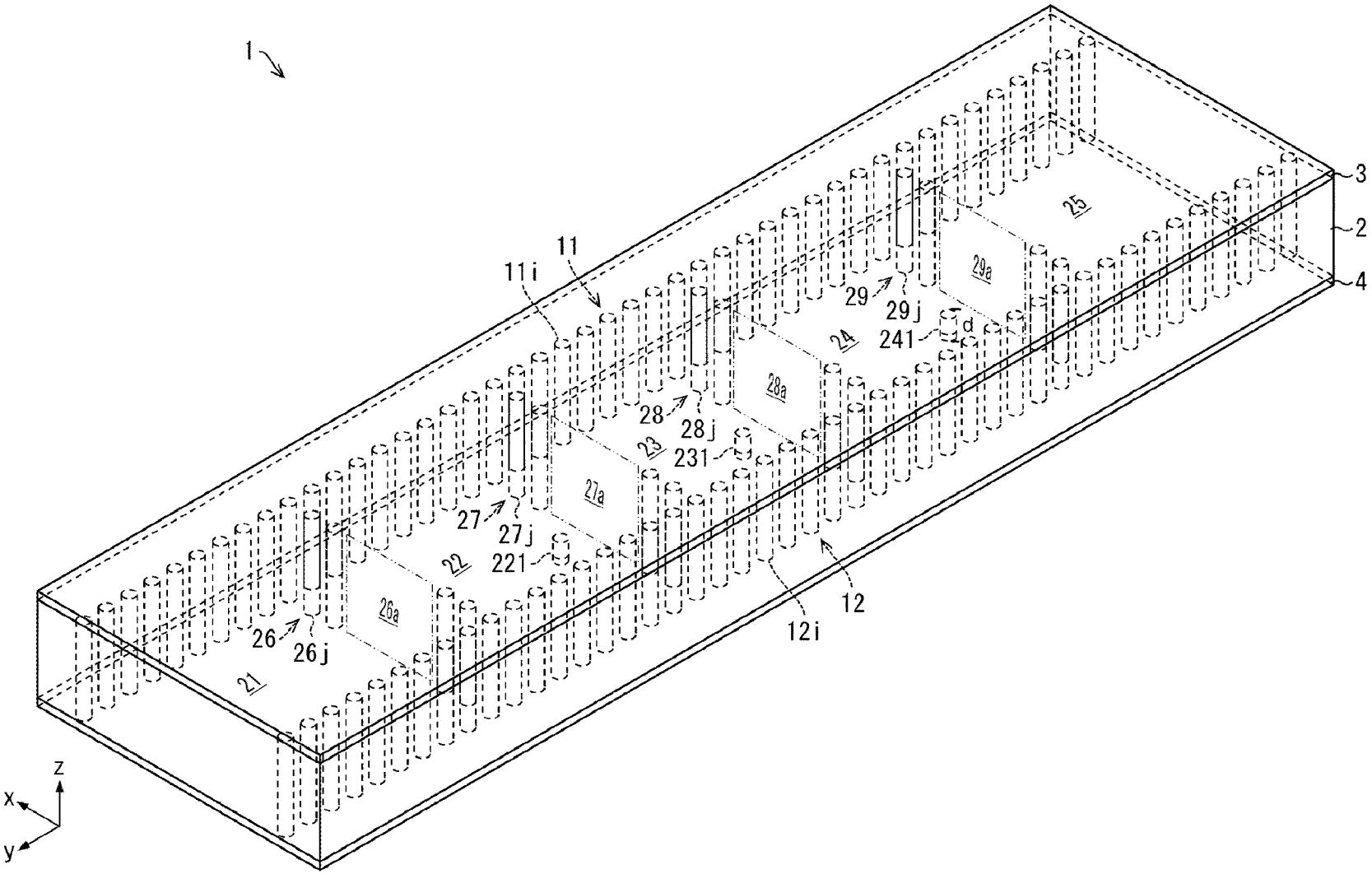
FIG. 1 is a perspective view illustrating a band-pass filter in accordance with Embodiment 1 of the present invention.
Figure 2:
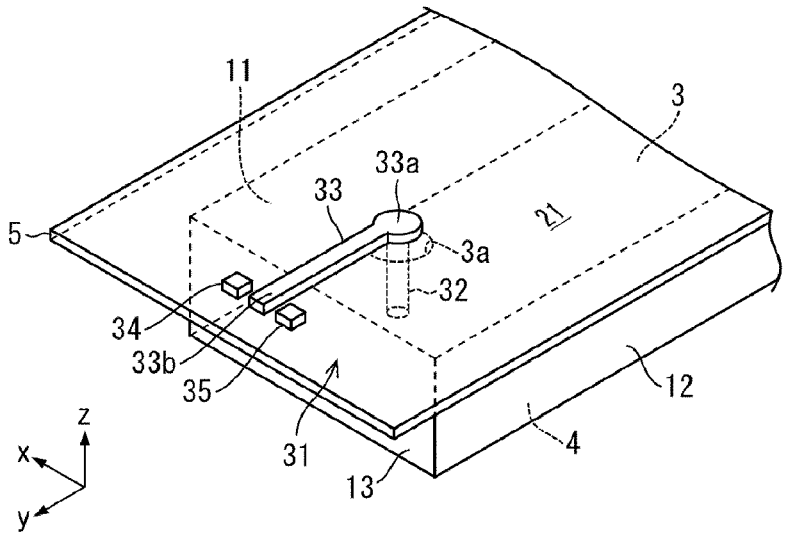
FIG. 2 is a perspective view illustrating a converter section of the band-pass filter illustrated in FIG. 1.

A band-pass filter (BPF) in accordance with Embodiment 1 of the present invention is described below with reference to FIGS. 1 and 2. FIG. 1 is a perspective view illustrating a BPF 1 in accordance with Embodiment 1 of the present invention. FIG. 2 is a perspective view illustrating a converter section 31 of the BPF 1. In FIGS. 1, 2,4, 7 and 10, a x-axis, a y-axis and a z-axis show a coordinate system in which the x-axis, the y-axis and the z-axis are perpendicular to one another.

As illustrated in FIG. 1, the BPF 1 includes a substrate 2 made of a dielectric substrate, a conductor layer 3 and a conductor layer 4, which are a pair of conductor layers, and a post wall 11 and a post wall 12.

The substrate 2 is a plate-like member made of a dielectric substrate. The substrate 2 has six surfaces. In the following descriptions, out of these six surfaces, the two surfaces having the largest area are referred to as "main surfaces" of the substrate 2. In Embodiment 1, quartz is used as a dielectric substrate of which the substrate 2 is made, but a dielectric substance different from quartz (for example, a resin such as a Teflon (Registered Trademark)-based resin (e.g., polytetrafluoroethylene) or a liquid polymer resin) can alternatively be used.

<Pair of Wide Walls>

The conductor layer 3 and the conductor layer 4 are a pair of conductor layers provided on the respective two main surfaces of the substrate 2. That is, the substrate 2, the conductor layer 3, and the conductor layer 4 have a laminated structure in which the substrate 2 is sandwiched by the conductor layers 3 and 4. In Embodiment 1, copper is used as a conductor of which the conductor layers 3 and 4 are made, but a conductor different from copper (for example, a metal such as aluminum) can alternatively be used. The conductor layers 3 and 4 can have any thickness that is not limited to any particular thickness. That is, the conductor layers 3 and 4 can be provided in the form of thin films, foil (films), or plates.

The conductor layers 3 and 4 constitute a pair of wide walls of a waveguide 21, a resonator 22, a resonator 23, a resonator 24, and a waveguide 25 each described later.

The substrate 2 has a plurality of through-holes provided in a fence-like manner when the main surfaces are viewed from above. In the plurality of through-holes, an interval between the respective through-holes is substantially equal to a diameter of the through-holes. The plurality of through-holes each pass through the substrate 2 from one to the other of the main surfaces of the substrate 2. A through-hole has an inner wall provided with a tubular conductor film. Thus, the tubular conductor film functions as a conductor post provided in the substrate 2 made of a dielectric substrate.

Furthermore, the tubular conductor film short-circuits the conductor layer 3 and the conductor layer 4 which are provided on the respective main surfaces of the substrate 2. Such a conductor post can be achieved with use of a post-wall waveguide technique (printed circuit board technique). <Post Wall>

A plurality of conductor posts provided in a fence-like manner at predetermined intervals is called a "post wall." The substrate 2 is provided with (i) a post wall 11 constituted by n conductor posts 11*i* (i is a notation obtained by generalizing an integer of not less than 1 and not more than n) provided in a fence-like manner, (ii) a post wall 12 constituted by n conductor posts 12*i* (i is a notation obtained by generalizing an integer of not less than 1 and not more than n) provided in a fence-like manner, (iii) a post wall 26 constituted by m conductor posts 26*j* (j is a notation obtained by generalizing an integer of not less than 1 and not more than m) provided in a fence-like manner, (iv) a post wall 27 constituted by m conductor posts 27*j* (j is a notation obtained by generalizing an integer of not less than 1 and not more than m) provided in a fence-like manner, (v) a post wall 28 constituted by m conductor posts 28*j* (j is a notation obtained by generalizing an integer of not less than 1 and not more than m) provided in a fence-like manner, and (vi) a post wall 29 constituted by m conductor posts 29*j* (j is a notation obtained by generalizing an integer of not less than 1 and not more than m) provided in a fence-like manner.

<Pair of Narrow Walls>

The conductor posts 11*i* constituting the post wall 11 are provided on a plane. Embodiment 1 defines a coordinate system so that the main surfaces of the substrate 2 are parallel to the xy plane and a plane on which the conductor posts 11*i* are provided is parallel to the yz plane (see FIG. 1). The post wall 11 constituted by the conductor posts 11*i* provided in a fence-like manner functions as a conductor wall that reflects an electromagnetic wave.

As in the case of the conductor posts 11*i* constituting the post wall 11, the conductor posts 12*i* constituting the post wall 12 are provided on a plane parallel to the yz plane. The post wall 12 constituted by the conductor posts 12*i* provided in a fence-like manner functions as a conductor wall that reflects an electromagnetic wave.

The post walls 11 and 12 constitute a pair of narrow walls of the waveguide 21, the resonator 22, the resonator 23, the resonator 24, and the waveguide 25 each described later.

<Partition Walls 26 to 29>

A space which is surrounded on all four sides by the conductor layers 3 and 4 and the post walls 11 and 12 and has a rectangular cross section functions as a rectangular waveguide that guides an electromagnetic wave in a y-axis direction.

The conductor posts 26*j* constituting the post wall 26 are provided on a plane parallel to the zx plane. The post wall 26 constituted by the conductor posts 26*j* provided in a fence-like manner functions as a conductor wall that reflects an electromagnetic wave.

As in the case of the conductor posts 26*j* constituting the post wall 26, the conductor posts 27*j* constituting the post wall 27 are provided on a plane parallel to the zx plane, the conductor posts 28*j* constituting the post wall 28 are provided on a plane parallel to the zx plane, and the conductor posts 29*j* constituting the post wall 29 are provided on a plane parallel to the zx plane. The post wall 27 constituted by the conductor posts 27*j* provided in a fence-like manner, the post wall 28 constituted by the conductor posts 28*j* provided in a fence-like manner, and the post wall 29 constituted by the conductor posts 29*j* provided in a fence-like manner each function as a conductor wall that reflects an electromagnetic wave.

Thus, the post walls 26 to 29 divide the rectangular waveguide into five sections, which are the waveguide 21, the resonator 22, the resonator 23, the resonator 24, and the waveguide 25. In view of the above, the post walls 26 to 29 are also referred to as respective partition walls 26 to 29.

In other words, the waveguide 21, the resonator 22, the resonator 23, the resonator 24, and the waveguide 25 are each surrounded on all four sides by the conductor layers 3 and 4 and the post walls 11 and 12. Besides, the waveguide 21 has a y-axis positive direction side end which is open and has a y-axis negative direction side end which is provided with the partition wall 26. The resonator 22 has a y-axis positive direction side end which is provided with the partition wall 26 and a y-axis negative direction side end which is provided with the partition wall 27. The resonator 23 has a y-axis positive direction side end which is provided with the partition wall 27 and a y-axis negative direction side end which is provided with the partition wall 28. The resonator 24 has a y-axis positive direction side end which is provided with the partition wall 28 and a y-axis negative direction side end which is provided with the partition wall 29. The waveguide 25 has a y-axis positive direction side end which is provided with the partition wall 29 and has a y-axis negative direction side end which is open.

The y-axis positive direction side end of the waveguide 21 and the y-axis negative direction side end of the waveguide 25 each function as an input/output port of the band-pass filter 1.

The conductor posts 26*j* are omitted at or near a center, in an x-axis direction, of the partition wall 26. That is, an opening 26*a* is provided at or near the center of the partition wall 26. The opening 26*a* does not reflect an electromagnetic wave. As a result, the waveguide 21 and the resonator 22 are electromagnetically coupled through the opening 26*a*. The opening 26*a* is also called an inductive iris. Similarly, openings 27*a*, 28*a* and 29*a* are provided at or near respective centers of the partition walls 27 to 29.

The BPF 1 thus configured is a coupled resonator BPF including three resonators 22 to 24 which are coupled in series. A width of a passband of the BPF 1 and a center frequency of the passband can be appropriately adjusted by adjusting respective design parameters of sections of the BPF 1. The BPF 1 does not necessarily need to include three resonators but can include any number of resonators.

<Recesses 221, 231, and 241>

According to Embodiment 1, the resonators 22, 23, and 24 are provided with respective recesses 221, 231, and 241. The recesses 221, 231, and 241 are each a cylindrical recess which passes through the conductor layer 4, which is one of the conductor layers 3 and 4, and leads to inside of the substrate 2. When the main surfaces of the substrate 2 are viewed from above, the recesses 221, 231, and 241 are provided on a central axis which passes through respective centers of the resonators 22 to 24. In the BPF 1, the recesses 221, 231, and 241 are provided at respective identical locations in the resonators 22 to 24. In other words, the resonators 23 and 24 are obtained by translating the resonator 22 in the y-axis direction by predetermined amounts. Furthermore, the recesses 221, 231, and 241 are equal in depth. The recesses 221, 231, and 241 have a depth d of, for example, 100 μm as described later in Examples.

The depth d of the recesses 221, 231, and 241 can be appropriately set. Note, however, that a deeper depth d tends to allow a larger amount of shift Δf of the center frequency to be obtained in a case where conductor films are provided on respective inner walls of the recesses 221, 231, and 241. The amount of shift Δf will be described later. Note that forming, on the respective inner walls of the recesses 221, 231, and 241, the conductor films which are electrically connected to the conductor layer 4 is also referred to as "metallizing."

Locations at which to provide the respective recesses 221, 231, and 241 can be appropriately set. Note, however, that the recesses 221, 231, and 241 which are provided at or near the respective centers of the resonators 22 to 24 tend to allow an increase in amount of shift Δf, whereas the recesses 221, 231, and 241 which are provided away from the respective centers of the resonators 22 to 24 (at or near the post walls 11 and 12 and the partition walls 26 to 29) tend to allow a reduction in amount of shift Δf.

According to the BPF 1, a center frequency thereof can be shifted to a low frequency side by forming, on the respective inner walls of the recesses 221, 231, and 241, the conductor films which are electrically connected to the conductor layer 4. The recesses 221, 231, and 241 which have the respective inner walls provided with the conductor films function as a kind of conductor posts inserted in the respective resonators 22 to 24. In accordance with the depth of the recesses 221, 231, and 241, the center frequency of the BPF 1 can be shifted to a low frequency side.

The center frequency of the BPF 1 which is manufactured with use of a printed circuit board technique may differ from the center frequency intended in designing the BPF 1 (hereinafter referred to as a "target center frequency"). Suppose cases where the center frequency of the BPF 1 thus differ from the target center frequency, in a case where the center frequency of the BPF 1 is shifted to a frequency higher than the target center frequency, the BPF 1 can shift the center frequency thereof to a low frequency side by forming the conductor films on the respective inner walls of the recesses 221, 231, and 241. Thus, the BPF 1 makes it possible to prevent or reduce an error between a center frequency and a target center frequency in a coupled resonator BPF.

According to a method for manufacturing the BPF 1 with use of the printed circuit board technique, a plurality of through-holes serving as a base of the conductor posts 11*i*, the conductor posts 12*i*, the conductor posts 26*j*, the conductor posts 27*j*, the conductor posts 28*j*, and the conductor posts 29*j* are collectively provided to the substrate 2. In this case, a manufacturing error may occur between (a) a diameter of the plurality of through-holes provided to the substrate 2 and (b) a diameter of the plurality of through-holes which diameter is intended in designing the BPF 1. The manufacturing error is considered to be substantially shared by the plurality of through-holes in the method for manufacturing the BPF 1 with use of the printed circuit board technique.

In view of the above, manufacturing errors which occur in the respective through-holes of the resonators 22 to 24 are considered to be substantially the same. Thus, in a case where the resonators 22 to 24 are configured to be provided with the respective recesses 221, 231, and 241, it is possible for the recesses 221, 231, and 241 which are provided in the respective resonators 22 to 24 to prevent or reduce an influence by manufacturing errors which occur in the respective resonators 22 to 24. This allows an error between the center frequency and the target center frequency to be prevented or reduced without fail.

Note, however, that a recess such as the recess 221 can be provided to at least one of the resonators 22 to 24 in the BPF 1.

According to Embodiment 1, metallizing is carried out by forming the conductor films on the respective inner walls of the recesses 221, 231, and 241. Note, however, that metallizing does not necessarily need to be carried out by such a method. Specifically, a plurality of conductor posts formed by metallizing can be provided in the respective recesses 221, 231, and 241 in the form of electric conductors which are electrically connected to the conductor layer 4 and are columnar or cylindrical. For example, these conductor posts can be formed of electrically conductive resin paste, with which the recesses 221, 231, and 241 are filled, instead of the conductor films provided on respective inner walls of the conductor posts.

<Converter Section>

A high-frequency device(s) different from the BPF 1 is/are coupled to the BPF 1 so as to be followed by and/or follow the BPF 1. Examples of a high-frequency device to be coupled to the BPF 1 include an antenna circuit, a transmitter circuit, a receiver circuit, and a directional coupler.

In the case of a high-frequency device which is preferably coupled to the BPF 1 with use of a rectangular waveguide (e.g., a directional coupler), an end of the rectangular waveguide of the high-frequency device can be coupled to an open end of the waveguide 21 or the waveguide 25 of the BPF 1.

In contrast, for the case of high-frequency devices each of which is preferably coupled to the BPF 1 with use of a microstrip line (e.g., a transmitter circuit and a receiver circuit), the converter section 31 illustrated in FIG. 2 can be provided to an open end of the BPF 1 so that the high-frequency device and the BPF 1 are coupled through the converter section 31. The following description briefly discusses a case where the converter section 31 is provided to an end (y-axis positive direction side end) of the waveguide 21.

In order to make a configuration of the converter section 31 easy to see, FIG. 2 schematically illustrates the waveguide 21, constituted by the conductor layers 3 and 4 and the post walls 11 and 12, not in the form of a rectangular waveguide constituted by post walls, but in the form of a rectangular waveguide constituted by imaginary planar walls and having a rectangular parallelepiped. Note that the substrate 2 is not illustrated in FIG. 2. Note also that the conductor layers 3 and 4 and the post walls 11 and 12 are each illustrated in FIG. 2 not in the form of a wall having a thickness, but by an imaginary plane.

As illustrated in FIG. 2, a short wall 13 is provided at a y-axis positive direction side end of the waveguide 21. As in the case of the post walls 11 and 12, the short wall 13 is a post wall obtained by arranging the plurality of conductor posts, provided in the substrate 2, in a fence-like manner. Specifically, in a case where the converter section 31 is provided, the y-axis positive direction side end of the waveguide 21 is not open and covered by the short wall 13.

As illustrated in FIG. 2, the converter section 31 includes not only the short wall 13 but also a dielectric layer 5, a blind via 32, a signal line 33, a conductor pad 34, and a conductor pad 35.

The dielectric layer 5 is a layer provided on a surface of the conductor layer 3 and made of a dielectric substrate. According to Embodiment 1, the dielectric layer 5 is made of a polyimide resin.

A part of the conductor layer 3 constituting a wide wall is provided with a circular opening 3*a*. A region which is a part of the substrate 2 constituting the waveguide 21 and is included in the opening 3*a* is provided with a non-through-hole which leads from outside to inside of the substrate 2. On an inner wall of the non-through-hole, a conductor film which is electrically connected to an end 33*a* of the signal line 33 (described later) is provided. The non-through-hole provided with such a conductor film is hereinafter referred to as the blind via 32.

A region of the dielectric layer 5 which region is included in the opening 3*a* is provided with a circular opening. The opening of the dielectric layer 5 is not illustrated in FIG. 2.

The signal line 33 is a strip-shaped conductor extended in the y-axis direction. The signal line 33 and the wide wall constituted by the conductor layer 3 which is separated from the signal line 33 by the dielectric layer 5 form a microstrip line. Of both ends of the signal line 33, the y-axis negative direction side end 33*a* is formed into a circle whose diameter is larger than that of the blind via 32. The end 33*a* is included in the opening 3*a* and provided so as to overlap an upper end of the blind via 32. The end 33*a* is electrically connected to the conductor film constituting the blind via 32.

Among the longitudinal ends of the signal line 33, a y-axis positive direction side end 33*b* is provided so as to be outside the waveguide 21 when the waveguide 21 is viewed from above from a z-axis positive direction side. On sides (an x-axis positive direction side and an x-axis negative direction side) of the end 33*b*, the conductor pad 34 and the conductor pad 35 are provided so that the end 33*b* is sandwiched therebetween. The conductor pad 34 and the conductor pad 35 are each provided so as to be spaced from the end 33*b*. The dielectric layer 5 which is located below the conductor pad 34 and the conductor pad 35 is provided with openings through which to electrically connect the conductor layer 3 to the conductor pad 34 and the conductor pad 35, respectively. Thus, the conductor pad 34 and the conductor pad 35 each function as a ground.

The conductor pad 34, the end 33*b* of the signal line 33, and the conductor pad 35 configure a so-called ground-signal-ground (GSG) electrode pattern, and an interval (pitch) at which the conductor pad 34, the end 33*b* of the signal line 33, and the conductor pad 35 are provided is configured to match an interval (pitch) at which terminals of a radio frequency integrated circuit (RFIC) including a transmitter circuit and/or a receiver circuit are provided. This makes it possible to easily connect the terminals of the RFIC to the converter section 31.

The blind via 32 can convert, to a mode of an electromagnetic wave which propagates through the waveguide 21 of the BPF 1, a mode of an electromagnetic wave which propagates through the microstrip line constituted by the signal line 33 and the conductor layer 3. As described above, in a case where the waveguide 21 is provided with the converter section 31, the high-frequency device including no rectangular waveguide can be easily coupled to the BPF 1 with low loss.

Embodiment 2

Figure 3:
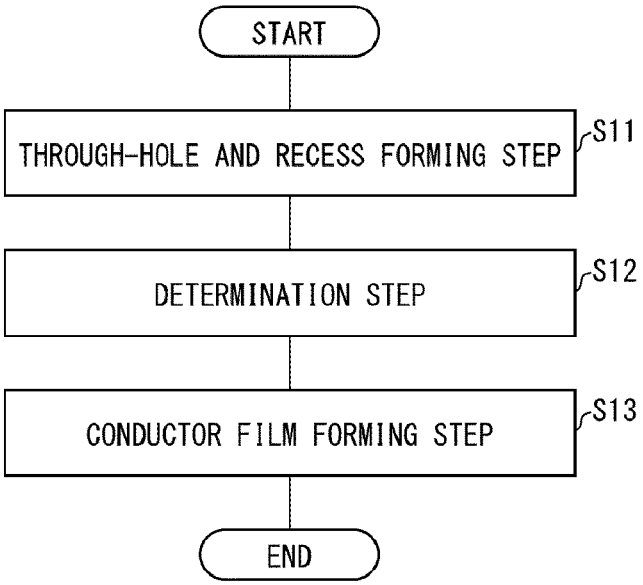
FIG. 3 is a flowchart showing a method for manufacturing a band-pass filter in accordance with Embodiment 2 of the present invention.

A method for manufacturing a band-pass filter in accordance with Embodiment 2 of the present invention is described below with reference to FIG. 3. FIG. 3 is a flowchart showing a method for manufacturing a band-pass filter in accordance with Embodiment 2. The present manufacturing method mainly relates to, of the method for manufacturing the BPF 1 illustrated in FIG. 1, a step of forming recesses 221, 231, and 241, and a step of forming conductor films on respective inner walls of the recesses 221, 231, and 241.

(Method for Manufacturing BPF 1)

As illustrated in FIG. 3, the present manufacturing method begins at "START" and ends at "END," and includes a through-hole and recess forming step S11, a determination step S12, and a conductor film forming step S13.

The through-hole and recess forming step S11 is a step of (1) providing a substrate 2 with a plurality of through-holes for forming conductor posts 11*i*, conductor posts 12*i*, conductor posts 26*j*, conductor posts 27*j*, conductor posts 28*j*, and conductor posts 29*j* and (2) providing the substrate 2 with the recesses 221, 231, and 241, each serving as an example of one (1) recess, in accordance with a predetermined pattern as shown in FIG. 1. The through-hole and recess forming step S11 can be carried out with use of a printed circuit board technique. Locations at which to provide the respective recesses 221, 231, and 241, and a depth d of the recesses 221, 231, and 241 can be appropriately set.

The determination step S12 is a step of measuring a diameter of any of the plurality of through-holes and determining, in accordance with a center frequency associated with the diameter, whether to form conductor films on respective inner walls of the recesses 221, 231, and 241.

In a case where the plurality of through-holes are formed with use of the printed circuit board technique, a diameter of the plurality of through-holes may include a manufacturing error of ±several % with respect to a diameter intended in designing the BPF 1. In a case where the plurality of through-holes have a diameter which is smaller than the diameter intended in designing the BPF 1, the center frequency is shifted to a frequency lower than a target center frequency. In contrast, for a case where the plurality of through-holes have a diameter which is larger than the diameter intended in designing the BPF 1, the center frequency is shifted to a frequency higher than the target center frequency. This is because of the following reason. Specifically, in a case where the plurality of through-holes have a diameter smaller than the diameter intended in designing the BPF 1, resonators 22 to 24 have a size larger than the size intended in designing the BPF 1. In contrast, for a case where the plurality of through-holes have a diameter larger than the diameter intended in designing the BPF 1, the resonators 22 to 24 have a size smaller than the size intended in designing the BPF 1.

In the present manufacturing method, a correlation between (a) the diameter of plurality of through-holes and (b) the center frequency of the BPF 1 is obtained in advance in the present manufacturing method.

By obtaining the correlation, the center frequency of the BPF 1 which is manufactured with use of the substrate 2 (i.e., the center frequency associated with the diameter of the through-holes) can be estimated, in the determination step S12, from the measured diameter of the through-holes. Then, in the determination step S12, the center frequency thus estimated and the target center frequency intended in designing the BPF 1 are compared, and, under a condition that the estimated center frequency is higher than the target center frequency and a difference between the target center frequency and the center frequency obtained in a case where the conductor films are formed is smaller than a difference between the target center frequency and the center frequency associated with the diameter, it is determined that the conductor films are to be provided to the respective inner walls of the recesses 221, 231, and 241. Furthermore, in the determination step S12, in a case where the above condition is not satisfied, it is determined that no conductor films are to be provided to the respective inner walls of the recesses 221, 231, and 241.

The conductor film forming step S13 is a step of providing conductor films to (i) respective two main surfaces of the substrate 2 and (ii) respective inner walls of the plurality of through-holes for forming the conductor posts ll*i*, the conductor posts 12*i*, the conductor posts 26*j*, the conductor posts 27*j*, the conductor posts 28*j*, and the conductor posts 29*j*. Through the conductor film forming step S13, conductor layers 3 and 4, and post walls 11, 12, 26, 27, 28, and 29 are formed as shown in FIG. 1.

In a case where it is determined, in the determination step S12, that the conductor films are to be provided to the respective inner walls of the recesses 221, 231, and 241, the conductor films are also provided to the respective inner walls of the recesses 221, 231, and 241 in the conductor film forming step S13 while the conductor films are being provided to the respective two main surfaces of the substrate 2 (described earlier) and to the respective inner walls of the plurality of through-holes (described earlier).

According to the present manufacturing method, in a case where the center frequency of the BPF 1 is estimated to be higher than the target center frequency, it is possible to shift the center frequency of the BPF 1 to a frequency lower than the estimated center frequency by forming the conductor films on the respective inner walls of the recesses 221, 231, and 241. Thus, the present manufacturing method makes it possible to prevent or reduce an error between a center frequency and a target center frequency in the BPF 1.

In Embodiment 2, the step of forming the through-holes and the step of forming the recesses are collectively carried out in the form of the through-hole and recess forming step S11. Note, however, that the step of forming the through-holes and the step of forming the recesses can alternatively be separately carried out in Embodiment 2.

In order to obtain the recesses 221, 231, and 241 in which no conductor films are provided, it is possible to (1) in the conductor film forming step S13, provide an opening part of a recess, in which no conductor film is to be provided, with a mask pattern which covers an opening of the recess or (2) in the conductor film forming step S13, without forming any particular mask pattern, provide a conductor film to an entire surface of the substrate 2 and then remove the conductor film from each of the respective inner walls of the recesses 221, 231, and 241.

Embodiment 3

Figure 4:
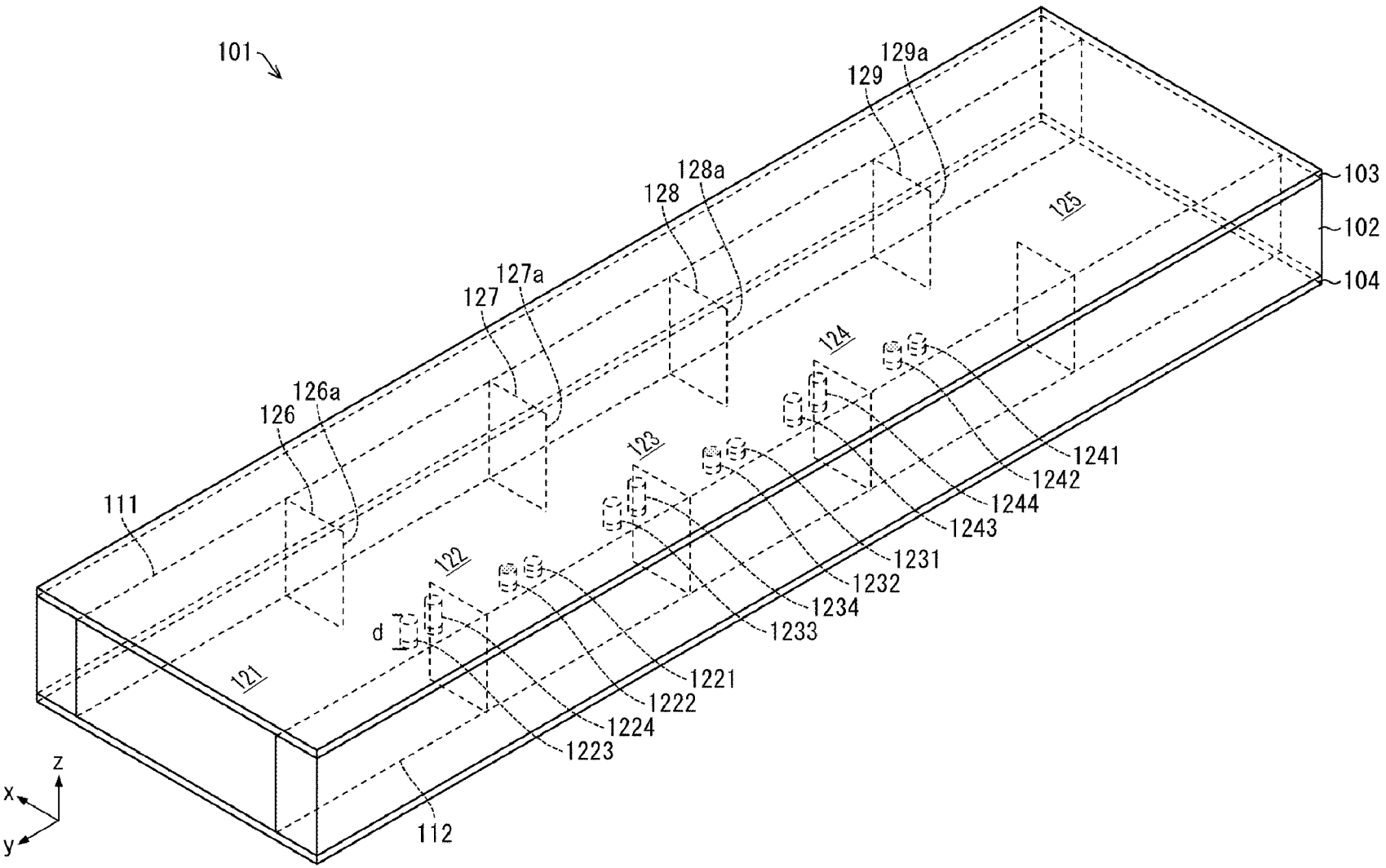
FIG. 4 is a perspective view illustrating a band-pass filter in accordance with Embodiment 3 of the present invention.

A BPF 101 in accordance with Embodiment 3 of the present invention is described below with reference to FIG. 4. FIG. 4 is a perspective view of the BPF 101. In order to improve visibility of a configuration of four recesses (recesses 1221, 1222, 1223 and 1224, 1231, 1232, 1233 and 1234, or 1241, 1242, 1243 and 1244) provided in each of resonators 122, 123 and 124, FIG. 4 schematically illustrates, not in the form of a post-wall waveguide constituted by post walls, but in the form of a rectangular waveguide constituted by imaginary planar walls, post walls 111 and 112 constituting the resonators and partition walls 126, 127, 128 and 129 constituting the resonators. The post walls 111 and 112 and the partition walls 126, 127, 128 and to 129 are each illustrated in FIG. 4 not in the form of a wall having a thickness, but by an imaginary plane. Thus, conductor posts 111*i*, conductor posts 112*i*, conductor posts 126*j*, conductor posts 127*j*, conductor posts 128*j*, and conductor posts 129*j* are omitted in FIG. 4.

The BPF 101 can be obtained by adding further recesses to the BPF 1 illustrated in FIG. 1. In Embodiment 3, a correspondence between the BPF 101 and the BPF 1 is made clear, and then points of difference between the BPF 101 and the BPF 1 are mainly described.

The BPF 101 includes a substrate 102 made of a dielectric substrate, a conductor layer 103 and a conductor layer 104, which are a pair of conductor layers, and the post wall 111 and the post wall 112. The substrate 102 is identical in configuration to the substrate 2 of the BPF 1. The conductor layers 103 and 104 are identical in configuration to the conductor layers 3 and 4 of the BPF 1. The post walls 111 and 112 are identical in configuration to the post walls 11 and 12 of the BPF 1.

Specifically, the BPF 101 includes a waveguide which is surrounded on all four sides by the conductor layers 103 and 104 (wide walls) and the post walls 111 and 112 (narrow walls). The waveguide is divided, by the partition walls 126, 127, 128, and 129, into a waveguide 121, the resonator 122, the resonator 123, the resonator 124, and a waveguide 125.

As in the case of the openings 26*a*, 27*a*, 28*a* and 29*a* provided to the respective partition walls 26 to 29 in Embodiment 1, openings 126*a*, 127*a*, 128*a* and 129*a* are provided to the respective partition walls 126 to 129. The BPF 101 thus configured is a coupled resonator BPF including three resonators which are coupled in series. The BPF 101 does not necessarily need to include three resonators but can include any number of resonators.

According to the BPF 101, the resonators 122, 123, and 124 are identical in configuration. Thus, Embodiment 3 describes the recesses 1221, 1222, 1223, and 1224 with use of the resonator 122.

The recesses 1221, 1222, 1223, and 1224 are each a cylindrical recess which passes through the conductor layer 104 and leads to inside of the substrate 102. When main surfaces of the substrate 102 are viewed from above, the recesses 1221, 1222, 1223, and 1224 are provided on a central axis which passes through a center of the resonator 122. The recesses 1221, 1222, 1223, and 1224 differ from each other in depth. According to Embodiment 3, the recess 1221 is the shallowest (has a depth of 25 μm in Embodiment 3), and the recess 1222 is deeper than the recess 1221 (has a depth of 50 μm in Embodiment 3), the recess 1223 is deeper than the recess 1222 (has a depth of 75 μm in Embodiment 3), and the recess 1224 is deeper than the recess 1223 (has a depth of 100 μm in Embodiment 3). According to Embodiment 3, the recess 1221 and the recess 1222 are provided closer to the opening 127*a* (y-axis negative direction) than the center of the resonator 122, and the recess 1221 is provided much closer to the opening 127*a* than the recess 1222. The recess 1223 and the recess 1224 are provided closer to the opening 126*a* than the center of the resonator 122, and the recess 1223 is provided much closer to the opening 126*a* than the recess 1224. Note, however, that the depth of each of the recesses 1221, 1222, 1223, and 1224 and locations at which to provide the respective recesses 1221, 1222, 1223, and 1224 can be appropriately set in accordance with how to design an amount of shift Δf of a center frequency, the amount of shift Δf being obtained in a case where conductor films are provided on respective inner walls of the recesses 1221, 1222, 1223, and 1224.

As in the case of the resonator 122, the resonator 123 is provided with the recesses 1231, 1232, 1233, and 1234, respectively, and the resonator 124 is provided with the recesses 1241, 1242, 1243, and 1244, respectively. (1) The recesses 1231 and 1241 each correspond to the recess 1221, (2) the recesses 1232 and 1242 each correspond to the recess 1222, (3) the recesses 1233 and 1243 each correspond to the recess 1223, and (4) the recesses 1234 and 1244 each correspond to the recess 1224. According to the BPF 101, four recesses (the recesses 1221 to 1224, 1231 to 1234, or 1241 to 1244) are thus provided to each of the resonators 122 to 124. By metallizing any one of these four recesses, it is possible to shift the center frequency to a low frequency side. In FIG. 4, the recesses 1222, 1232 and 1242 include a conductive film.

The description of Embodiment 3 assumes that, as shown in Table 1, (i) the amount of shift Δf which is obtained in a case where the recesses 1221, 1231, and 1241 are metallized is having a value (a) in GHz, (ii) the amount of shift Δf which is obtained in a case where the recesses 1222, 1232, and 1242 are metallized is having a value (b) in GHz, (iii) the amount of shift Δf which is obtained in a case where the recesses 1223, 1233, and 1243 are metallized is having a value (c) in GHz, and (iv) the amount of shift Δf which is obtained in a case where the recesses 1224, 1234, and 1244 are metallized is having a value (d) in GHz.

TABLE 1

| | Recesses 1221, 1231, and 1241 | Recesses 1222, 1232, and 1242 | Recesses 1223, 1233, and 1243 | Recesses 1224, 1234, and 1244 |
|---|---|---|---|---|
| Amount of shift Δf | a | b | c | d |

Since four recesses are thus provided in each of the resonators 122 to 124, it is possible to (i) select, from four amounts of shift Δf which are associated with the respective four recesses, an amount of shift Δf which is in accordance with an error between a center frequency and a target center frequency of a band-pass filter and (ii) select a recess whose depth is associated with the amount of shift Δf thus selected. Thus, the configuration makes it possible to further prevent or reduce an error between the center frequency and the target center frequency as compared with a case where one (1) recess is provided in a resonator (e.g., the BPF 1 illustrated in FIG. 1).

Embodiment 4

Figure 5:
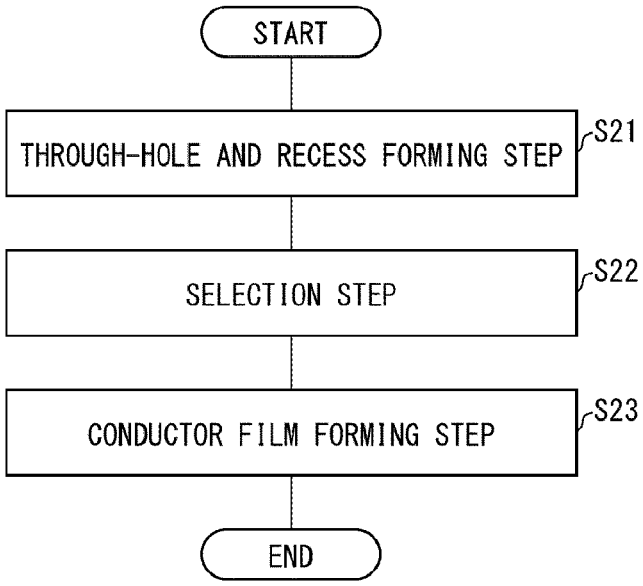
FIG. 5 is a flowchart showing a method for manufacturing a band-pass filter in accordance with Embodiment 4 of the present invention.

A method for manufacturing a band-pass filter in accordance with Embodiment 4 of the present invention is described below with reference to FIG. 5. FIG. 5 is a flowchart showing a method for manufacturing a band-pass filter in accordance with Embodiment 4. The present manufacturing method mainly relates to, of the method for manufacturing the BPF 101 illustrated in FIG. 4, a step of forming recesses 1221 to 1224, recesses 1231 to 1234, and recesses 1241 to 1244, and a step of forming a conductor film on an inner wall of each of (i) any one of the recesses 1221 to 1224, (ii) any one of the recesses 1231 to 1234, and (iii) any one of the recesses 1241 to 1244.

(Method for manufacturing BPF 101)

As illustrated in FIG. 5, the present manufacturing method begins at "START" and ends at "END," and includes a through-hole and recess forming step S21, a selection step S22, and a conductor film forming step S23. In Embodiment 4, a correspondence between the present manufacturing method and the manufacturing method shown in FIG. 3 is made clear, and then points of difference between the present manufacturing method and the manufacturing method shown in FIG. 3 are mainly described.

The through-hole and recess forming step S21 is a step corresponding to the through-hole and recess forming step S11 included in the manufacturing method shown in FIG. 3. The through-hole and recess forming step S21 is a step of providing a substrate 102 with (1) a plurality of through-holes for forming (i) conductor posts constituting post walls 111 and 112 and (ii) conductor posts constituting partition walls 126 to 129 and (2) the recesses 1221 to 1224, which are four recesses provided in the resonator 122 and differ in depth, the recesses 1231 to 1234, which are four recesses provided in the resonator 123 and differ in depth, and the recesses 1241 to 1244, which are four recesses provided in the resonator 124 and differ in depth.

The selection step S22 is a step corresponding to the determination step S12 included in the manufacturing method shown in FIG. 3. In the selection step S22, a diameter of any of the plurality of through-holes formed in the through-hole and recess forming step S21 is measured. Then, in the selection step S22, (1) in a case where a center frequency associated with the diameter is higher than a target center frequency set as a target in designing the BPF 101, a first difference is calculated, the first difference being a difference obtained by subtracting, from the target center frequency, the center frequency associated with the diameter, (2) a second difference is calculated, the second difference being a difference between the target center frequency and respective center frequencies, obtained in a case where conductor films are provided on respective inner walls of the plurality of recesses, and a recess which has the smallest second difference is selected as a candidate recess from the four recesses 1221 to 1224, a recess which has the smallest second difference is selected as a candidate recess from the four recesses 1231 to 1234, and a recess which has the smallest second difference is selected as a candidate recess from the four recesses 1241 to 1244, and (3) the candidate recess is selected as a selected recess under a condition that the second difference corresponding to the candidate recess is smaller than the first difference. Furthermore, in the selection step S22, in a case where the above condition is not satisfied, the candidate recess is not selected as the selected recess in the recesses 1221 to 1224, 1231 to 1234, or 1241 to 1244.

In the present manufacturing method, (i) the amount of shift Δf which is obtained in a case where the recesses 1221, 1231, and 1241 are metallized, (ii) the amount of shift Δf which is obtained in a case where the recesses 1222, 1232, and 1242 are metallized, (iii) the amount of shift Δf which is obtained in a case where the recesses 1223, 1233, and 1243 are metallized, and (iv) the amount of shift Δf which is obtained in a case where the recesses 1224, 1234, and 1244 are metallized are obtained in advance. The description of Embodiment 4 also assumes that, as shown in Table 1 described in Embodiment 3, (i) the amount of shift Δf which is obtained in a case where the recesses 1221, 1231, and 1241 are metallized is having a value (a) in GHz, (ii) the amount of shift Δf which is obtained in a case where the recesses 1222, 1232, and 1242 are metallized is having a value (b) in GHz, (iii) the amount of shift Δf which is obtained in a case where the recesses 1223, 1233, and 1243 are metallized is having a value (c) in GHz, and (iv) the amount of shift Δf which is obtained in a case where the recesses 1224, 1234, and 1244 are metallized is having a value (d) in GHz.

Assume, for example, that a difference obtained by subtracting, from the target center frequency set as a target in designing the BPF 101, the center frequency associated with the diameter is c GHz in the selection step S22. In this case, with reference to Table 1, the recesses 1223, 1233, and 1243 are each a recess which allows the difference to be minimized. Thus, in the selection step S22, the recess 1223 is selected from the recesses 1221 to 1224, the recess 1233 is selected from the recesses 1231 to 1234, and the recess 1243 is selected from the recesses 1241 to 1243.

Assume, for example, that a difference obtained by subtracting, from the target center frequency, the center frequency associated with the diameter is the closest to the value (a) in GHz of the value (a) in GHz to the value (d) in GHz. In this case, with reference to Table 1, the recesses 1221, 1231, and 1241 are each a recess which allows the difference to be minimized. Thus, the recesses 1221, 1231, and 1241 are selected in the selection step S22.

The conductor film forming step S23 is a step of providing conductor films to (i) respective two main surfaces of the substrate 102 and (ii) respective inner walls of a plurality of through-holes for forming conductor posts 111*i*, conductor posts 112*i*, conductor posts 126*j*, conductor posts 127*j*, conductor posts 128*j*, and conductor posts 129*j*. Through the conductor film forming step S23, conductor layers 103 and 104 and the post walls 111, 112, 126, 127, 128, and 129 are formed. As described above, conductor posts 111*i*, conductor posts 112*i*, conductor posts 126*j*, conductor posts 127*j*, conductor posts 128*j*, and conductor posts 129*j* are omitted in FIG. 4.

The conductor film forming step S23 is also a step of forming a conductor film on an inner wall of the selected recess selected in the selection step S22. The conductor film forming step S23 is a step corresponding to the conductor film forming step S13 included in the manufacturing method shown in FIG. 3. In order not to provide a conductor film in a recess different from the selected recess, the conductor film forming step S23 can include (1) a step of providing an opening part of a recess, in which no conductor film is to be provided, with a mask pattern which covers an opening of the recess or (2) a step of, without forming any particular mask pattern, providing a conductor film to an entire surface of the substrate 102 and then removing the conductor film from an inner wall of the recess different from the selected recess.

In Embodiment 4, the step of forming the through-holes and the step of forming the recesses are collectively carried out in the form of the through-hole and recess forming step S21. Note, however, that the step of forming the through-holes and the step of forming the recesses can alternatively be separately carried out in Embodiment 4.

Example 1

Figure 6:
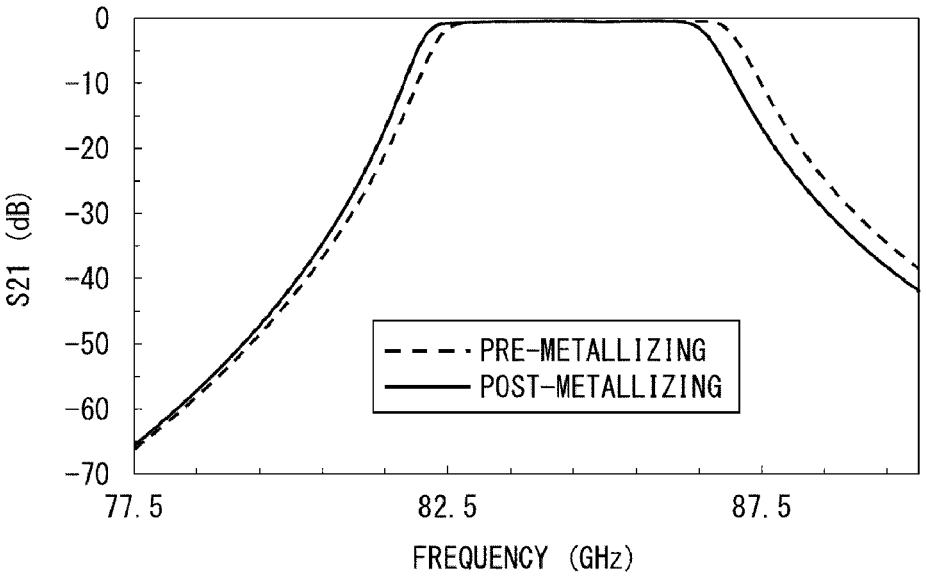
FIG. 6 shows graphs each showing a transmission characteristic of a band-pass filter, which is Example 1 of the present invention.

The following description discusses, as Example 1 of the present invention, a result of a simulation carried out with use of the configuration of the BPF 1 illustrated in FIG. 1. FIG. 6 shows graphs each showing frequency dependence of an S parameter S21 in dB vs. frequency in GHz of the BPF 1 of Example 1. The following description refers to the frequency dependence of the S parameter S21 as a transmission characteristic of the BPF 1.

In Example 1, a design parameter of the BPF 1 was set as below.

The BPF 1 included five resonators.

An interval, measured in the x-axis direction, between the post wall 11 and the post wall 12 was set to 1500 μm.

An interval, measured in the y-axis direction, between the respective partition walls was appropriately set so as to fall within the range of not less than 1000 μm and not more than 1200 μm.

The substrate 2 was a glass substrate having a thickness of 500 μm and made of quartz glass.

The quartz glass had a specific inductive capacity of 3.823.

The diameter of a plurality of conductor posts was set to 100 μm, and an interval between adjacent conductor posts was set to 300 μm.

The diameter of a recess was set to 100 μm, and the depth d of the recess was set to 75 μm.

A plot of "PRE-METALLIZING" shown in FIG. 6 indicates a transmission characteristic of the BPF 1, the transmission characteristic having been obtained as a result of a simulation carried out in a state in which the conductor films had not been formed on the respective inner walls of the recesses provided in the respective resonators.

A plot of "POST-METALLIZING" shown in FIG. 6 indicates a transmission characteristic of the BPF 1, the transmission characteristic having been obtained as a result of a simulation carried out in a state in which the conductor films had been formed on the respective inner walls of the recesses provided in the respective resonators.

A comparison made, with reference to FIG. 6, between (a) the transmission characteristic of the BPF 1 having been metallized and (b) the transmission characteristic of the BPF 1 to be metallized shows that a passband of the BPF 1 having been metallized has been shifted to a lower frequency side as a whole than that of the BPF 1 to be metallized. It was revealed that a center frequency of the passband is shifted to a low frequency side by approximately 0.4 GHz by forming the conductor films on the respective inner walls of the recesses of the BPF 1.

Example Group 2

Figure 7:
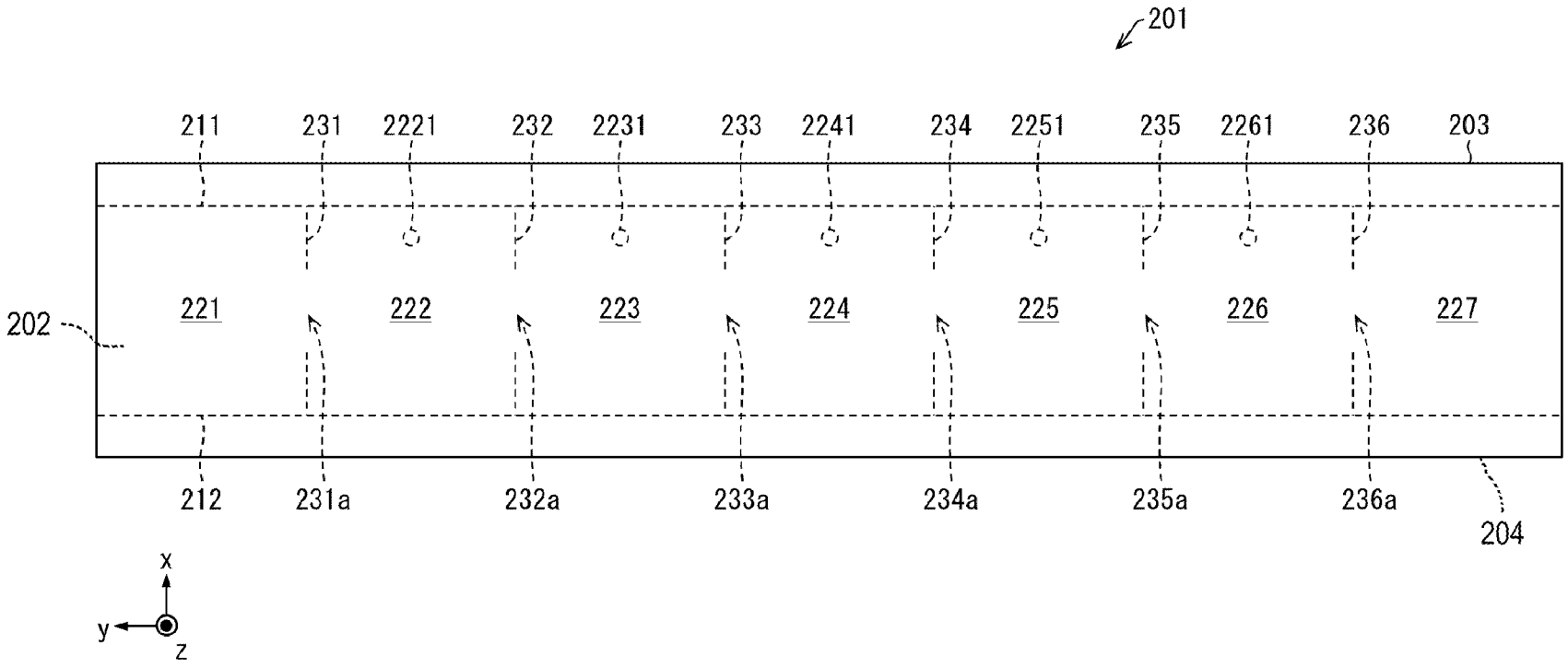
FIG. 7 is a plan view illustrating a band-pass filter, which is Example Group 2 of the present invention.
Figure 8:
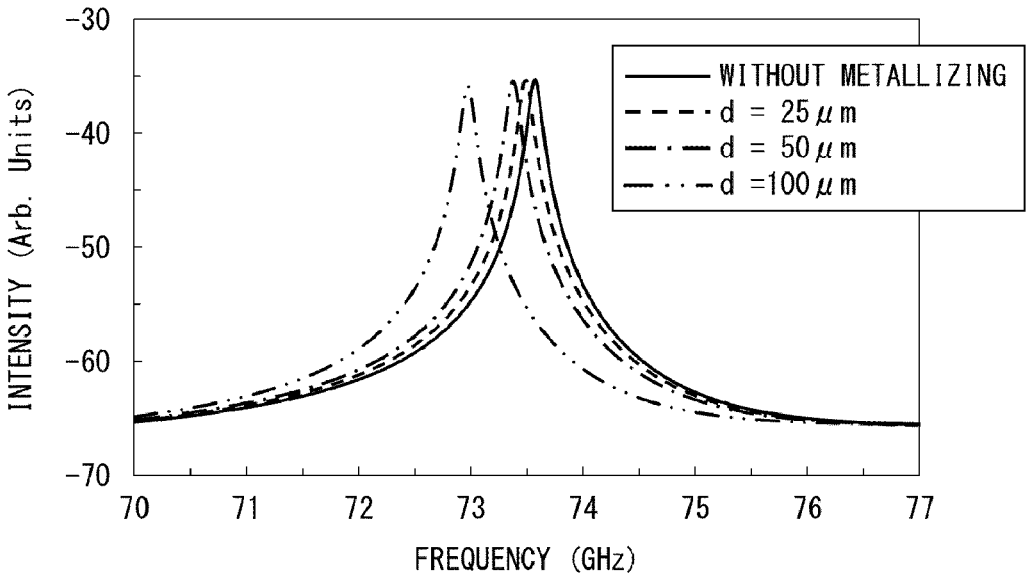
FIG. 8 shows graphs showing respective resonance frequencies of band-pass filters belonging to Example Group 2 of the present invention.
Figure 9:
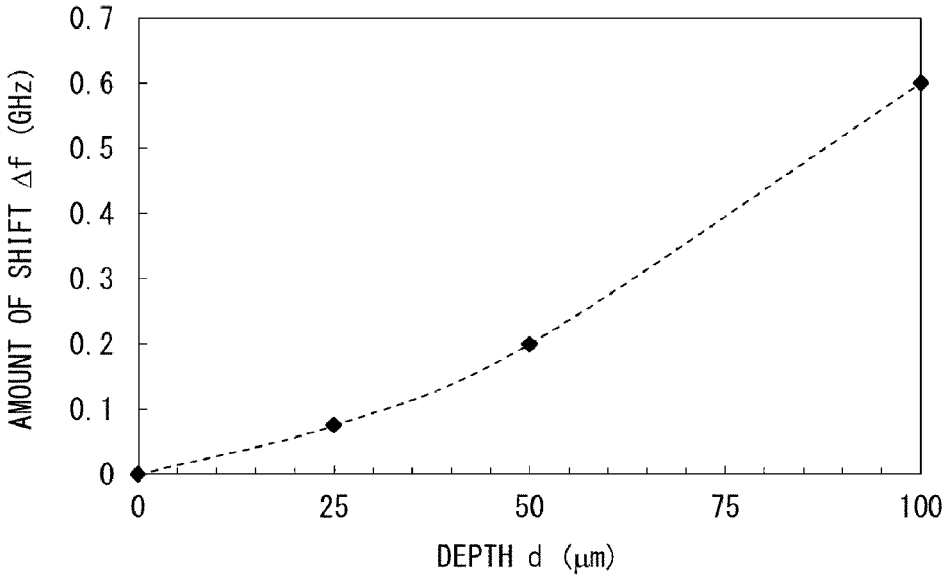
FIG. 9 shows a graph showing a correlation, obtained in each of the band-pass filters belonging to Example Group 2 of the present invention, between a depth d of a recess and an amount of shift Δf of a center frequency.

A BPF obtained by changing, in the BPF 1, which is Example 1, locations at which to provide the respective recesses was used as a BPF 201 belonging to Example Group 2. FIG. 7 is a plan view of the BPF 201 belonging to Example Group 2. FIG. 8 shows graphs showing frequency dependence of resonance frequencies, the frequency dependence having been obtained as a result of a simulation carried out with use of a BPF 201 belonging to Example Group 2. FIG. 9 shows a graph showing a correlation, obtained in each BPF 201 belonging to Example Group 2, between the depth d and the amount of shift Δf. FIG. 7 schematically illustrates post walls 211 and 212 and partition walls 231, 232, 233, 234, 235 and 236 not in the form of a post-wall waveguide constituted by post walls, but in the form of a rectangular waveguide constituted by imaginary planar walls. These imaginary planar walls are each illustrated in FIG. 7 not in the form of a wall having a thickness, but by an imaginary plane.

As illustrated in FIG. 7, a BPF 201 includes a substrate 202 made of a dielectric substrate, a conductor layer 203 and a conductor layer 204, which are a pair of conductor layers, and the post wall 211 and the post wall 212, and the partition walls 231 to 236. The partition walls 231 to 236 are provided with respective openings 231*a*, 232*a*, 233*a*, 234*a*, 235*a* and 236*a*. Note that the substrate 202 and the conductor layer 204, each of which is located below the conductor layer 203, are illustrated in FIG. 7.

The substrate 202 is similar in configuration to the substrate 2 of the BPF 1. The conductor layers 203 and 204 are similar in configuration to the conductor layers 3 and 4 of the BPF 1. The post walls 211 and 212 are similar in configuration to the post walls 11 and 12 of the BPF 1. The partition walls 231 to 236 are similar in configuration to the partition walls 26 to 29 of the BPF 1. The BPF 201 includes five resonators 222, 223, 224, 225 and 226, which are partitioned off by the partition walls 231 to 236, and waveguides 221 and 227. That is, the number of resonators included in the BPF 201 is five. The waveguides 221 and 227 are similar in configuration to the waveguides 21 and 25 of the BPF 1. The resonators 222 to 226 are similar in configuration to the resonators 22 to 24 of the BPF 1.

The following description discusses a configuration of the BPF 201 with use of the resonator 222, which is one of the resonators 222 to 226. The resonators 223 to 226 are similar in configuration to the resonator 222. That is, recesses 2231, 2241, 2251, and 2261 are identical in configuration to a recess 2221. Thus, Example Group 2 only describes the recess 2221 and does not describe the recesses 2231, 2241, 2251, and 2261.

According to the resonator 222 included in each BPF 201 belonging to Example Group 2, the recess 2221 is provided at an intersection of (1) a straight line extending in the y-axis direction and located at a distance of 300 μm from the post wall 211 and (2) a straight line extending in the x-axis direction and located at an equal distance from each of the two partition walls 231 and 232.

Example Group 2 carried out a simulation with use of the BPF 201 including the resonators provided with the recesses having depths d of 25 μm, 50 μm, and 100 μm.

In FIG. 8, a resonance frequency of a BPF 201 whose recess is not metallized (i.e. without metallizing) is shown with a solid line, a resonance frequency of a BPF 201 whose recess has been metallized and has a depth d of 25 μm is shown with a broken line, a resonance frequency of a BPF 201 whose recess has been metallized and has a depth d of 50 μm is shown with a dotted and dashed line, and a resonance frequency of a BPF 201 whose recess has been metallized and has a depth d of 100 μm is shown with a chain double-dashed line. In FIG. 8, the vertical axis shows a signal intensity in arbitrary units, and the horizontal axis shows a frequency in GHz.

FIG. 8 shows that a resonance frequency of a BPF 201 is shifted to a lower frequency side by causing a recess provided in a resonator to have a deeper depth d. Thus, a center frequency of a passband of the BPF 201 is shifted to a lower frequency side as a recess to be metallized has a deeper depth d was revealed. In FIG. 9, the horizontal axis shows a depth d.

FIG. 9 shows that for the amount of shift Δf in GHz vs. depth d in μm, the amount being obtained in a case where a recess is metallized, monotonously increases, in the range of 0 μm≤depth d≤100 μm, as a recess provided in each of the resonators has a deeper depth d.

Example 3

Figure 10:
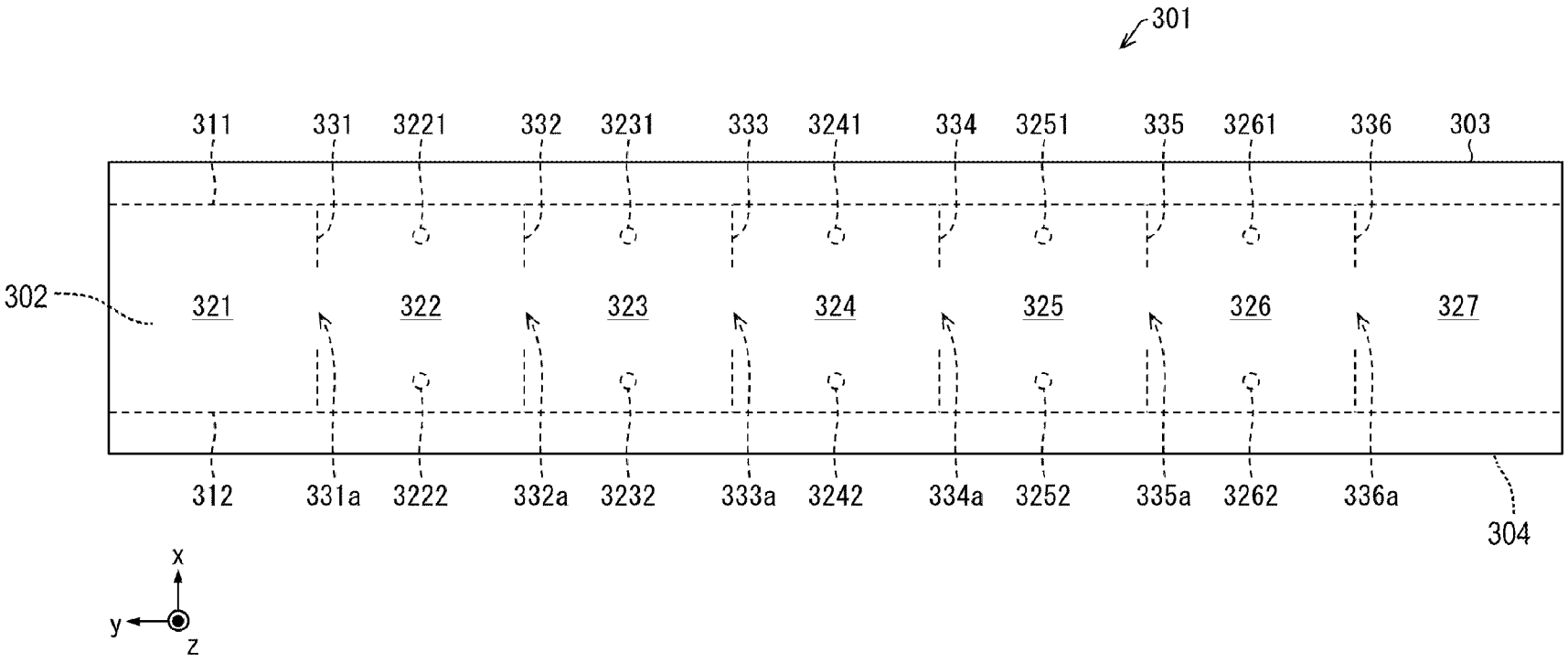
FIG. 10 is a plan view illustrating a band-pass filter, which is Example 3 of the present invention.

A BPF 301, which is Example 3 of the present invention, is described below with reference to FIG. 10. FIG. 10 is a plan view of the BPF 301 of Example 3. FIG. 10 schematically illustrates post walls 311 and 312 and partition walls 331, 332, 333, 334, 335 and 336 not in the form of a post-wall waveguide constituted by post walls, but in the form of a rectangular waveguide constituted by imaginary planar walls. These imaginary planar walls are each illustrated in FIG. 10 not in the form of a wall having a thickness, but by an imaginary plane.

As illustrated in FIG. 10, the BPF 301 includes a substrate 302 made of a dielectric substrate, a conductor layer 303 and a conductor layer 304, which are a pair of conductor layers, and the post wall 311 and the post wall 312, and the partition walls 331 to 336. The partition walls 331 to 336 are provided with respective openings 331*a* to 336*a*. Note that the substrate 302 and the conductor layer 304, each of which is located below the conductor layer 303, are illustrated in FIG. 10.

The substrate 302 is identical in configuration to the substrate 202 of the BPF 201. The conductor layers 303 and 304 are identical in configuration to the conductor layers 203 and 204 of the BPF 201. The post walls 311 and 312 are identical in configuration to the post walls 211 and 212 of the BPF 201. The partition walls 331 to 336 are identical in configuration to the partition walls 231 to 236 of the BPF 201. As in the case of the BPF 201, the BPF 301 includes five resonators 322, 323, 324, 325 and 326 and waveguides 321, 327. The following description discusses a configuration of the BPF 301 with use of the resonator 322, which is one of the resonators 322 to 326. The resonators 323 to 326 are similar in configuration to the resonator 322. Recesses 3231, 3241, 3251, and 3261 are identical in configuration to a recess 3221. Recesses 3232, 3242, 3252, and 3262 are identical in configuration to a recess 3222. Thus, Example 3 only describes the recess 3221 and the recess 3222, and does not describe the recesses 3231, 3241, 3251, and 3261, and the recesses 3232, 3242, 3252, and 3262. The BPF 301 includes openings 331*a*, 332*a*, 333*a*, 334*a*, 335*a*, 336*a*.

As illustrated in FIG. 10, the resonator 322 is provided with the two recesses 3221 and 3222. The recess 3221 is provided at a location identical to the location of the recess 2221 illustrated in FIG. 7. Specifically, the recess 3221 is provided at an intersection of (1) a straight line extending in the y-axis direction and located at a distance of 300 μm from the post wall 311 and (2) a straight line extending in the x-axis direction and located at an equal distance from each of the two partition walls 331 and 332. The recess 3221 has a depth d (not shown) of 50 μm.

The recess 3222 and the recess 3221 are provided so as to be symmetrical with respect to a straight line passing through a center of the resonator 322 and extending in the y-axis direction. Specifically, the recess 3222 is provided at an intersection of (1) a straight line extending in the y-axis direction and located at a distance of 300 μm from the post wall 312 and (2) a straight line extending in the x-axis direction and located at an equal distance from each of the two partition walls 331 and 332. The recess 3222 has a depth d (not shown) of 100 μm.

The recess 3221 is provided at a location identical to the location of the recess 2221 provided in the resonator 222 constituting the BPF 201. Thus, an amount of shift Δf which is obtained in a case where the recess 3221 is metallized is equal to an amount of shift Δf which is obtained in a case where the recess 2221, which has a depth d of 50 μm, is metallized. Thus, the amount of shift Δf which is obtained in a case where the recess 3221 is metallized is 0.2 GHz The recess 3222 is equal to the recess 3221 in distance from the post wall and in distance from the center of the resonator. Thus, an amount of shift Δf which is obtained in a case where the recess 3222 is metallized is equal to an amount of shift Δf which is obtained in a case where the recess 2221, which is provided in the resonator 222 constituting the BPF 201 and has a depth d of 100 μm, is metallized. Thus, the amount of shift Δf which is obtained in a case where the recess 3222 is metallized is 0.6 GHz.

Assume, for example, that a difference obtained by subtracting, from a target center frequency set as a target in designing the BPF 301, a center frequency associated with the diameter of a through-hole is 0.3 GHz in the selection step S22 shown in FIG. 5. In this case, the recess 3221 is a recess which allows the difference to be minimized. Thus, in the selection step S22, the recess 3221 is selected as a recess to metallize. Assume, for example, that a difference obtained by subtracting, from the target center frequency set as a target in designing the BPF 301, the center frequency associated with the diameter is 0.5 GHz in the selection step S22. In this case, the recess 3222 is a recess which allows the difference to be minimized. Thus, in the selection step S22, the recess 3222 is selected as a recess to metallize.

Aspects of the present invention can also be expressed as follows:

A band-pass filter (1, 101, 201, 301) in accordance with an aspect of the present invention includes: a substrate (2, 102, 202, 302) made of a dielectric substrate and including a pair of conductor layers (3 and 4, 103 and 104, 203 and 204, 303 and 304, respectively) provided on respective both sides of the substrate; and a post wall (11, 12, 111, 112, 211, 212, 311, 312, respectively) constituted by a plurality of conductor posts (11*i*, 12*i*, 111*i*, 112*i*, 211*i*, 212*i*, 311*i*, 312*i*, respectively) which pass through the substrate (2, 102, 202, 302, respectively) and short-circuit the pair of conductor layers (3 and 4, 103 and 104, 203 and 204, 303 and 304, respectively). The pair of conductor layers (3 and 4, 103 and 104, 203 and 204, 303 and 304, respectively) and the post wall (11, 12, 111, 112, 211, 212, 311, 312, respectively) constitute a plurality of resonators (22 to 24, 122 to 124, 222 to 226, 322 to 326, respectively) which are electromagnetically coupled, the pair of conductor layers serving as a pair of wide walls of the plurality of resonators, the post wall serving as a narrow wall of the plurality of resonators. According to the present band-pass filter (1, 101, 201, 301), the plurality of resonators (22 to 24, 122 to 124, 222 to 226, 322 to 326) include at least one resonator (22 to 24, 122 to 124, 222 to 226, 322 to 326) which is provided with at least one recess (221, 231, 241, 1221 to 1224, 1231 to 1234, 1241 to 1244, 2221, 2231, 2241, 2251, 2261, 3221, 3222, 3231, 3232, 3241, 3242, 3251, 3252, 3261, 3262) which passes through either one (the conductor layer (4, 104, 204, 304)) of the pair of wide walls and directly leads to inside the substrate (2, 102, 202, 302).

The present band-pass filter thus configured is a coupled resonator band-pass filter which uses a post-wall waveguide. The present band-pass filter makes it possible to shift a center frequency to a low frequency side by forming, on an inner wall of a recess, a conductor film which is electrically connected to a wide wall. Thus, in a case where a center frequency of a band-pass filter is higher than the center frequency (target center frequency) intended in designing the band-pass filter, the present band-pass filter allows the center frequency to be closer to the target center frequency. This allows the present band-pass filter to prevent or reduce an error between a center frequency and a target center frequency in a BPF which uses a PWW.

The band-pass filter (1, 101, 201, 301) in accordance with an aspect of the present invention is preferably configured such that the at least one recess (221, 231, 241, 1221 to 1224, 1231 to 1234, 1241 to 1244, 2221, 2231, 2241, 2251, 2261, 3221, 3222, 3231, 3232, 3241, 3242, 3251, 3252, 3261, 3262) is provided in each of the plurality of resonators (22 to 24, 122 to 124, 222 to 226, 322 to 326).

The present band-pass filter can be manufactured with use of a method for manufacturing a printed circuit board. According to a manufacturing method carried out with use of a printed circuit board technique, a plurality of through-holes are collectively provided to a substrate. In this case, a manufacturing error may occur between (a) a diameter of the plurality of through-holes provided to the substrate and (b) a diameter of the plurality of through-holes which diameter is intended in designing the band-pass filter. The manufacturing error is considered to be substantially shared by the plurality of through-holes.

In view of the above, manufacturing errors which occur in the respective through-holes of the resonators are considered to be substantially the same. Thus, with the configuration, it is possible for the recesses which are provided in the respective resonators to prevent or reduce an influence by manufacturing errors which occur in the respective resonators. This allows an error between the center frequency and the target center frequency to be prevented or reduced without fail.

The band-pass filter (1, 201) in accordance with an aspect of the present invention is preferably configured such that: the at least one recess (221, 231, 241, 2221, 2231, 2241, 2251, 2261) which is provided in the at least one resonator (22 to 24, 222 to 226) is one recess; the one recess (221, 231, 241, 2221, 2231, 2241, 2251, 2261) has an inner wall provided with a conductor film which is electrically connected to the either one (the conductor layer (4, 204)) of the pair of wide walls.

According to the present band-pass filter, by forming a conductor film on an inner wall of a recess, it is possible to prevent or reduce an error between a center frequency and a target center frequency even in a case where one (1) recess is provided in a resonator.

The band-pass filter (101, 301) in accordance with an aspect of the present invention is preferably configured such that the at least one recess (1221 to 1224, 1231 to 1234, 1241 to 1244, 3221, 3222, 3231, 3232, 3241, 3242, 3251, 3252, 3261, 3262) which is provided in the at least one resonator (122 to 124, 322 to 326) comprises a plurality of recesses (1221 to 1224, 1231 to 1234, 1241 to 1244, 3221, 3222, 3231, 3232, 3241, 3242, 3251, 3252, 3261, 3262) which differ in depth.

The band-pass filter (101, 301) in accordance with an aspect of the present invention is preferably configured such that the plurality of recesses (1221 to 1224, 1231 to 1234, 1241 to 1244, 3221, 3222, 3231, 3232, 3241, 3242, 3251, 3252, 3261, 3262) include at least one recess (1221 to 1224, 1231 to 1234, 1241 to 1244, 3221, 3222, 3231, 3232, 3241, 3242, 3251, 3252, 3261, 3262) which has an inner wall provided with a conductor film.

An amount in which to shift a center frequency to a low frequency side by providing a recess in a resonator is larger as a recess whose inner wall is provided with a conductor film has a deeper depth. In view of this, with the configuration, it is possible to select a recess whose depth is in accordance with an error between a center frequency of a band-pass filter and a target center frequency of the band-pass filter. Thus, the configuration makes it possible to further prevent or reduce an error between the center frequency and the target center frequency as compared with a case where one (1) recess is provided in a resonator.

A method in accordance with an aspect of the present invention for manufacturing a band-pass filter (1, 101, 201, 301) (a manufacturing method shown in FIG. 3 or FIG. 5) preferably includes: a through-hole forming step of forming a plurality of through-holes for providing the plurality of conductor posts (11*i*, 12*i*, 111*i*, 112*i*, 211*i*, 212*i*, 311*i*, 312*i*) to the substrate (2, 102, 202, 302); and a recess forming step of forming the at least one recess (221, 231, 241, 1221 to 1224, 1231 to 1234, 1241 to 1244, 2221, 2231, 2241, 2251, 2261, 3221, 3222, 3231, 3232, 3241, 3242, 3251, 3252, 3261, 3262) which passes through the either one (the conductor layer (4, 104, 204, 304)) of the pair of wide walls, the either one constituting at least any one (22 to 24, 122 to 124, 222 to 226, 322 to 326) of the plurality of resonators (22 to 24, 122 to 124, 222 to 226, 322 to 326), and directly leads to inside the substrate (2, 102, 202, 302). Note that the through-hole forming step and the recess forming step are an aspect of the through-hole and recess forming step S11 shown in FIG. 3 or the through-hole and recess forming step S21 shown in FIG. 5.

The method in accordance with an aspect of the present invention for manufacturing the band-pass filter (1, 201) (the manufacturing method shown in FIG. 3) preferably further includes a determination step (S12) and a conductor film forming step (S13). The method is preferably configured such that one (221, 231, 241, 2221, 2231, 2241, 2251, 2261) of the at least one recess is provided to the at least one (22 to 24, 222 to 226) of the plurality of resonators (22 to 24, 222 to 226) in the recess forming step (a part of the through-hole and recess forming step S11), the determination step (S12) is a step of measuring a diameter of any of the plurality of through-holes and determining, in accordance with a center frequency associated with the diameter, whether to form a conductor film on an inner wall of the one (221, 231, 241, 2221, 2231, 2241, 2251, 2261) of the at least one recess, and the conductor film forming (S13) is a step of forming the conductor film on the inner wall of the one (221, 231, 241, 2221, 2231, 2241, 2251, 2261) of the at least one recess in a case where the determination step determines that the conductor film is to be formed on the inner wall of the one (221, 231, 241, 2221, 2231, 2241, 2251, 2261) of the at least one recess.

The method in accordance with an aspect of the present invention for manufacturing the band-pass filter (1, 201) is preferably configured such that: in the determination step, the center frequency associated with the diameter and a target center frequency set as a target in designing the band-pass filter are compared; and in a case where the center frequency associated with the diameter is higher than the target center frequency and a difference between the target center frequency and the center frequency (obtained in a case where the conductor film is formed) is smaller than a difference between the target center frequency and the center frequency associated with the diameter, the determination step determines that the conductor film is to be formed.

The method in accordance with an aspect of the present invention for manufacturing the band-pass filter (101, 301) (the manufacturing method shown in FIG. 5) preferably further includes a selection step (S22) and a conductor film forming step (S23). The method is preferably configured such that the at least one recess which is formed in the recess forming step (a part of the through-hole and recess forming step S21) comprises a plurality of recesses (1221 to 1224, 1231 to 1234, 1241 to 1244, 3221, 3222, 3231, 3232, 3241, 3242, 3251, 3252, 3261, 3262) which are provided to the at least one (122 to 124, 322 to 326) of the plurality of resonators (122 to 124, 322 to 326) and differ in depth, the selection step (S22) is a step of measuring a diameter of any of the plurality of through-holes, and, in a case where a center frequency associated with the diameter is higher than a target center frequency set as a target in designing the band-pass filter, (1) calculating a first difference, which is a difference between the target center frequency and the center frequency associated with the diameter, (2) calculating a second difference, which is a difference between the target center frequency and respective center frequencies obtained in a case where conductor films are provided on respective inner walls of the plurality of recesses (1221 to 1224, 1231 to 1234, 1241 to 1244, 3221, 3222, 3231, 3232, 3241, 3242, 3251, 3252, 3261, 3262), and selecting, from the plurality of recesses (1221 to 1224, 1231 to 1234, 1241 to 1244, 3221, 3222, 3231, 3232, 3241, 3242, 3251, 3252, 3261, 3262), a recess, which has the smallest second difference, as a candidate recess, and (3) selecting the candidate recess as a selected recess in a case where the second difference corresponding to the candidate recess is smaller than the first difference, and the conductor film forming step (S13) is a step of forming a conductor film on an inner wall of the selected recess.

Such a manufacturing method in accordance with an aspect of the present invention brings about an effect similar to that brought about by a band-pass filter in accordance with any one of the aspects (described earlier) of the present invention.

The present invention is not limited to the embodiments, but can be altered by a skilled person in the art within the scope of the claims. The present invention also encompasses, in its technical scope, any embodiment derived by combining technical means disclosed in differing embodiments.

REFERENCE SIGNS LIST

1, 101, 201, 301 Band-pass filter (BPF)
2, 102, 202, 302 Substrate
3 and 4, 103 and 104, 203 and 204, 303 and 304 Conductor layer (pair of conductor layers)
11, 12, 111, 112, 211, 212, 311, 312 Post wall
11*i*, 12*i* Conductor post
22, 23, 24, 122, 123, 124 Resonator
221, 231, 241, 1221, 1222, 1223, 1224, 1231, 1232, 1233, 1234, 1241, 1242, 1243, 1244, 2221, 3221, 3222 Recess
26*a*, 27*a*, 28*a*, 29*a*, 126*a*, 127*a*, 128*a*, 129*a* Opening

The invention claimed is:

1. A band-pass filter comprising:

a substrate made of a dielectric substrate and including a pair of conductor layers provided on respective two opposite sides of the substrate; and a post wall constituted by a plurality of conductor posts which pass through the substrate and short-circuit the pair of conductor layers, the pair of conductor layers and the post wall constituting a plurality of resonators which are electromagnetically coupled, the pair of conductor layers serving as a pair of wide walls of the plurality of resonators, the post wall serving as a narrow wall of the plurality of resonators, the plurality of resonators including at least one resonator which is provided with at least one recess which passes through either one of the pair of wide walls and directly leads to inside the substrate, wherein the at least one recess which is provided in the at least one resonator comprises a plurality of recesses which differ in depth.

2. The band-pass filter as set forth in claim 1, wherein the at least one recess is provided in each of the plurality of resonators.

3. The band-pass filter as set forth in claim 1, wherein the plurality of recesses include at least one recess which has an inner wall provided with a conductor film.

4. A method for manufacturing a band-pass filter recited in claim 1, said method comprising:

a through-hole forming step of forming a plurality of through-holes for providing the plurality of conductor posts to the substrate; and a recess forming step of forming the at least one recess which passes through the either one of the pair of wide walls, the either one constituting at least one of the plurality of resonators, and directly leads to inside the substrate.

5. The method as set forth in claim 4, wherein one of the at least one recess is provided to the at least one of the plurality of resonators in the recess forming step, said method further comprising:

a determination step of measuring a diameter of any of the plurality of through-holes and determining, in accordance with a center frequency associated with the diameter, whether to form a conductor film on an inner wall of the one of the at least one recess; and a conductor film forming step of forming the conductor film on the inner wall of the one of the at least one recess in a case where the determination step determines that the conductor film is to be formed on the inner wall of the one of the at least one recess.

6. The method as set forth in claim 5, wherein:

in the determination step, the center frequency associated with the diameter and a target center frequency set as a target in designing the band-pass filter are compared; and in a case where the center frequency associated with the diameter is higher than the target center frequency and a difference between the target center frequency and the center frequency obtained in a case where the conductor film is formed is smaller than a difference between the target center frequency and the center frequency associated with the diameter, the determination step determines that the conductor film is to be formed.

7. The method as set forth in claim 4, wherein the at least one recess which is formed in the recess forming step comprises the plurality of recesses which are provided to the at least one of the plurality of resonators and differ in depth, said method further comprising:

a selection step of measuring a diameter of any of the plurality of through-holes, and, in a case where a center frequency associated with the diameter is higher than a target center frequency set as a target in designing the band-pass filter, (1) calculating a first difference, which is a difference between the target center frequency and the center frequency associated with the diameter, (2) calculating a second difference, which is a difference between the target center frequency and respective center frequencies obtained in a case where conductor films are provided on respective inner walls of the plurality of recesses, and selecting, from the plurality of recesses, a recess, which has the smallest second difference, as a candidate recess, and (3) selecting the candidate recess as a selected recess in a case where the second difference corresponding to the candidate recess is smaller than the first difference; and a conductor film forming step of forming a conductor film on an inner wall of the selected recess.

* * * * *